US008943657B1

(12) United States Patent
Perry et al.

(10) Patent No.: US 8,943,657 B1
(45) Date of Patent: Feb. 3, 2015

(54) FLOWER POT URN AND URN COMBINATION FOR CREMATION REMAINS

(71) Applicants: Mark L Perry, Pittsfield, MA (US); Catherine Perry, Pittsfield, MA (US)

(72) Inventors: Mark L Perry, Pittsfield, MA (US); Catherine Perry, Pittsfield, MA (US)

( * ) Notice: Subject to any disclaimer, the term of this patent is extended or adjusted under 35 U.S.C. 154(b) by 0 days.

(21) Appl. No.: 13/941,473

(22) Filed: Dec. 4, 2013

(51) Int. Cl.
*A61G 17/00* (2006.01)
*A61G 17/08* (2006.01)

(52) U.S. Cl.
CPC ..... *A61G 17/08* (2013.01)
USPC ..... 27/1; 47/66.6; 47/41.01

(58) Field of Classification Search
USPC ..... 27/1; 47/66.6, 41.01; D99/5; 211/85.23; 206/423
See application file for complete search history.

(56) References Cited

U.S. PATENT DOCUMENTS

| | | | | |
|---|---|---|---|---|
| 2,799,972 | A * | 7/1957 | Teixeira | 47/86 |
| 3,906,666 | A * | 9/1975 | Daenen et al. | 47/41.13 |
| 5,029,373 | A * | 7/1991 | Raymond | 27/1 |
| D390,323 | S * | 2/1998 | Parker et al. | D99/19 |
| 5,735,075 | A * | 4/1998 | Honkawa et al. | 47/41.12 |
| 5,815,897 | A * | 10/1998 | Longstreth | 27/1 |
| 6,539,665 | B1 * | 4/2003 | Llona | 47/65.5 |
| 7,722,000 | B2 * | 5/2010 | Sherburne | 248/27.8 |
| 7,904,998 | B2 * | 3/2011 | Motz et al. | 27/10 |
| 8,490,258 | B1 * | 7/2013 | Muthusami | 27/1 |
| 2005/0039398 | A1 * | 2/2005 | Corona | 47/66.6 |
| 2008/0057456 | A1 * | 3/2008 | Carroll | 431/253 |
| 2014/0096444 | A1 * | 4/2014 | Castleberry | 47/41.01 |

* cited by examiner

*Primary Examiner* — William Miller
(74) *Attorney, Agent, or Firm* — Keohane & D'Alessandro PLLC; Madeline F. Schiesser

(57) ABSTRACT

A flower pot and urn put together to make it possible to display a pet or loved one's cremated remains in a way like never before is generally provided. In a typical embodiment, a flower pot and urn are molded closely together so plants or flowers can drape around the urn. The pot and urn may be set on a mantel or table depending on the size or, for larger sizes, put in any room in a house. An embodiment of the present invention presents a combination flower pot and urn on a base that acts as a drip pan for the flower pot and a stand for the urn to keep it up out of the water.

11 Claims, 2 Drawing Sheets

FLOWER POT URN AND URN COMBINATION FOR CREMATION REMAINS

TECHNICAL FIELD OF THE INVENTION

This invention relates to a molded flower pot and cremation urn for a family pet or human, and makes a new way to display the urn in the family home or business, or anywhere you would like to.

BACKGROUND OF THE INVENTION

Flower pots have been around for about 10,000 years. North America was experimenting with the use of cremation. By 1800 two instances of cremation had already been recorded. Cremation began to be more commonly practiced in 1876.

Even though flower pots and urn have long been around, nowhere is there a flower pot and urn made to be displayed as in embodiments of the present invention.

DETAILED DESCRIPTION OF THE INVENTION

Figure 1:
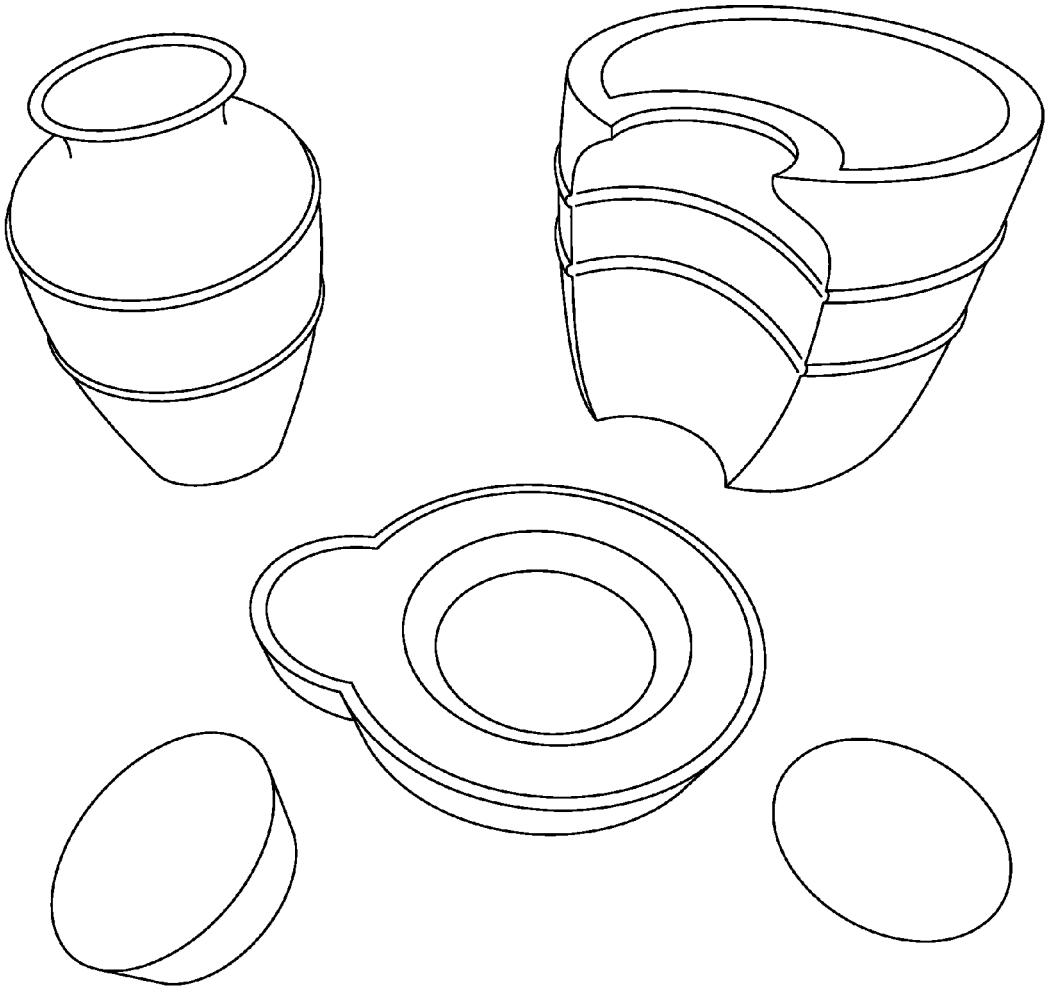
FIG. 1 of the drawings shows all the pieces of an embodiment of the present invention separate from each other before they are molded, these pieces can be of different shapes and sizes.
Figure 2:
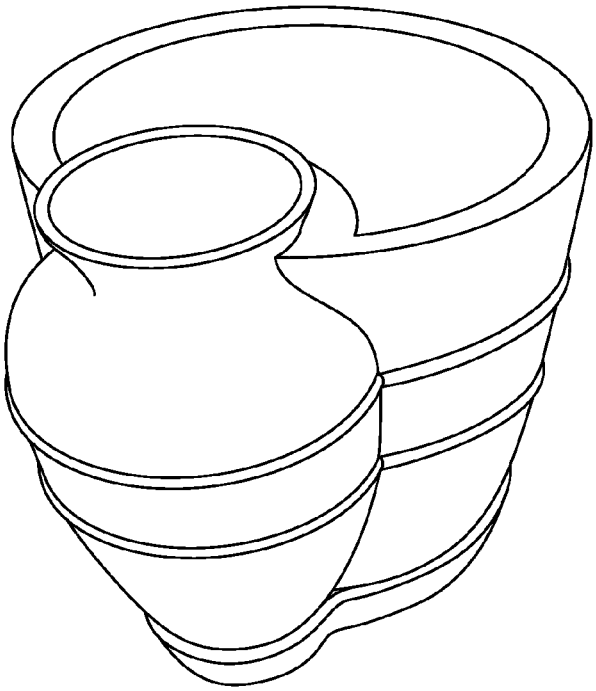
FIG. 2 shows the flower pot and urn together placed on the base in an embodiment of the present invention.
Figure 3:
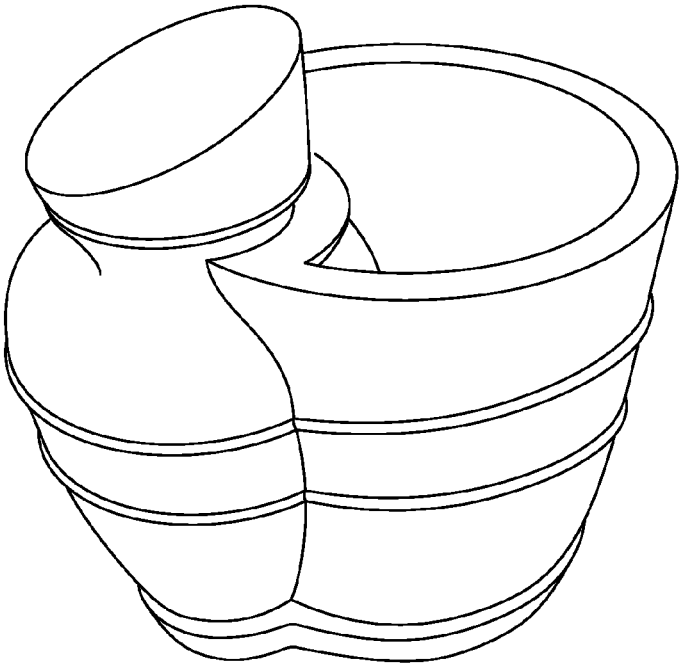
FIG. 3 shows the urn and flower pot together with a slanted lid resting on top of the urn in an embodiment of the present invention.

An embodiment of the present invention is a combination of a flower pot that has been molded along with a cremation urn, for pets or humans, made to be put together and sit in a base/drip pan, so as to be able to put plants or flowers, whether live or fake, into the flower pot side of the invention and have the urn look as though it is part of the flower pot. This will allow one to display the cremated remains as never before.

The a molded flower pot and urn shown in the figures happens to be round but embodiments could be of any shape or size. The urn is set inside the flower pot about half way; this makes the flower pot look as though it wraps itself around the urn. With the urn and flower pot together on the base, the base is the flower pot's drip pan, such that one could put live plants or flowers into it and grow them just as with a normal flower pot. The urns stand lifts the urn up from where the water would go to keep the urn from getting wet or dirty from the flower pots dirt and water.

The urn, flower pot, and base may be made from any material that could be molded, such as but not limited to, ceramic, plastic, fiberglass, wood, composites, etc. And in fact different sizes will be needed because of the different sizes of animals and people. In some embodiments, there will be small keep sake urns for those who want to divide the cremated remains amongst other family or friends. In other embodiments, there will be small, medium and large size urns for those who want to keep all the cremated remains in the same urn whether it is the family pet or a loved one. The flower pot portion will be sized accordingly to fit the size of the urn keeping the proportions similar for a nice look.

The flower pot and urn are totally separate from each other, molded individually, so as to keep the flowers and cremated remains apart from one another. Once cremated remains are in the urn, the lid of choice, e.g., slanted, rounded, flat, etc., is placed and the urn glued shut.

Flowers or plants can be put into the flower pot. They can be changed for the seasons or holidays and may be live or fake plants and flowers. The pot and urn may be set on the mantle or table or anywhere in or out of the house.

The essence of this invention isn't the size or shape of the flower pot and urn but the combination of having a flower pot and urn built or molded together and put into the base and having it displayed with the plants or flowers, giving the appearance that the urn is set inside the flower pot, or the appearance the flower pot is wrapping around the urn. In some embodiments, different sizes and shapes will be desired because of the different sizes of animals and people; there are more cremated remains with the larger size of the animal or person. And giving the choice of how to display cremated remains is part of the invention.

The invention claimed is:

1. A cremation remains displaying device, comprising:

a flower pot having an external molded cavity formed therein;

an urn for storing cremation remains at least partially fitting the molded cavity; and a base molded to comprise a stand which receives the urn and an adjacent recessed drip pan over which the flower pot is received.

2. The cremation remains displaying device of claim 1, wherein the base holds the urn and flower pot substantially together.

3. The cremation remains displaying device of claim 1, wherein the sides of the base cover the bottoms of the flower pot and urn about one inch.

4. The cremation remains displaying device of claim 1, further comprising:

a lid, set and glued in place over the urn.

5. The cremation remains displaying device of claim 1, further comprising:

a plant or a flower, living or artificial, wherein the plant or flower is set within the flower pot.

6. The cremation remains displaying device of claim 1, the flower pot, urn, and base comprising at least one of: ceramic, marble, stone, metal, wood, plastic, and fiberglass.

7. A method of displaying cremated remains, the method comprising:

forming a flower pot to have an external recessed area for receiving an urn therein;

forming the urn to store cremated remains and which is at least partially received by the recessed area of the flower pot; and forming a base having a stand to receive the urn and an adjacent recessed drip pan over which to receive the flower pot.

8. The method of claim 7, further comprising:

setting the flower pot upon the base over the drip pan; and setting the urn upon the stand of the base.

9. The method of claim 7, further comprising:

receiving cremated remains in the urn through an opening; and gluing a lid in place over the opening.

10. The method of claim 7, further comprising:

receiving a plant or flower in the flower pot; and watering the plant or flower in the flower pot, wherein water from the watering enters the drip pan but does not contact the urn.

11. The method of claim 7, wherein the flower pot, urn, and base are comprised of at least one of: ceramic, marble, stone, metal, wood, plastic, and fiberglass.

* * * * *

UNITED STATES PATENT AND TRADEMARK OFFICE

CERTIFICATE OF CORRECTION

PATENT NO. : 8,943,657 B1
APPLICATION NO. : 13/941473
DATED : February 3, 2015
INVENTOR(S) : Mark L. Perry et al.

It is certified that error appears in the above-identified patent and that said Letters Patent is hereby corrected as shown below:

On the Title Page:

Item 54 and in the Specification, column 1, line 1, Title, After "POT" Delete "URN".

In the Specification:

Column 1, Line 24, Delete "all the".

Signed and Sealed this
Twelfth Day of May, 2015

Michelle K. Lee

Michelle K. Lee
*Director of the United States Patent and Trademark Office*